US007365625B2

(12) United States Patent
Carrasco-Aguirre

(10) Patent No.: US 7,365,625 B2
(45) Date of Patent: Apr. 29, 2008

(54) TANK FOR ELECTRICAL APPARATUS IMMERSED IN FLUID

(75) Inventor: Raymundo Carrasco-Aguirre, Monterrey (MX)

(73) Assignee: Prolec GE,S.de R.L. de C.V., Apodaca, N.L. (MX)

( * ) Notice: Subject to any disclaimer, the term of this patent is extended or adjusted under 35 U.S.C. 154(b) by 268 days.

(21) Appl. No.: 11/370,354

(22) Filed: Mar. 8, 2006

(65) Prior Publication Data

US 2006/0201799 A1 Sep. 14, 2006

(30) Foreign Application Priority Data

Mar. 11, 2005 (MX) ..... NL/A/2005/000025

(51) Int. Cl.
*H01F 27/02* (2006.01)

(52) U.S. Cl. ..... 336/90

(58) Field of Classification Search ..... 336/55–62, 336/90–96, 220–221
See application file for complete search history.

(56) References Cited

U.S. PATENT DOCUMENTS 4,890,086 A * 12/1989 Hill ..... 336/210
6,661,322 B1 * 12/2003 Anger ..... 336/57
6,933,824 B2 * 8/2005 Marusinec et al. ..... 336/198

FOREIGN PATENT DOCUMENTS

| | | |
|---|---|---|
| ES | 208369 | 7/1975 |
| GB | 2050069 | 12/1980 |
| JP | 61135104 | 6/1984 |

* cited by examiner

*Primary Examiner*—Tuyen T. Nguyen
(74) *Attorney, Agent, or Firm*—Egbert Law Offices

(57) ABSTRACT

A tank for an electrical apparatus immersed in fluid is formed by a couple of long opposite of opposing walls where any of them have one or more supporting folds; and a couple of short opposite or alternate opposing walls joined to the long walls on their lateral ends, which defines a structure generally parallelepiped-shaped and such lateral ends join defines a supporting curvature. There is a base joined to the lower ends of the parallelepiped; and a cover joined to the upper ends of the parallelepiped covering an internal volume that accommodate at least one core, one or more windings, and the electrical apparatus fluid. Supporting folds define channels that allow them to accommodate inside them the lateral legs and the lower yoke of the core. The tank can be applied to electrical apparatus like transformers, autotransformers, and reactors and the like.

18 Claims, 5 Drawing Sheets

TANK FOR ELECTRICAL APPARATUS IMMERSED IN FLUID

RELATED U.S. APPLICATIONS

Not applicable.

STATEMENT REGARDING FEDERALLY SPONSORED RESEARCH OR DEVELOPMENT

Not applicable.

REFERENCE TO MICROFICHE APPENDIX

Not applicable.

FIELD OF THE INVENTION

This invention is related to an electrical apparatus immersed in fluid such as a transformer, auto-transformer, reactor, and the like, and in particular, but not exclusively, to a tank structure that contains such an electrical apparatus.

BACKGROUND OF THE INVENTION

Nowadays, electrical apparatuses, such as transformers, autotransformers, or reactors are immersed in one or more liquid or gaseous fluids or combinations of both to ensure their electrical isolation or refrigeration. Therefore, in order to keep those electrical apparatuses immersed in one or more fluids, it is required to be contained in a structure called a tank. The fluids currently used for this purpose are liquids, such as oil or askarel, or gases, such as nitrogen, air or fluorine gases. So, hereafter the term fluid will be used to name them and any other liquid or gas, or a combination of both acting as isolation and/or refrigerant for those electrical apparatuses.

Conventional tanks for an electrical apparatus are generally cube-shaped or rectangular-parallelepiped structures that consist substantially of four vertical lateral walls, one lower wall or horizontal base, and one higher wall or horizontal cover. During the assembling, these walls are joined to each other by welding lines and reinforced through support members of a plurality of channel type or bed type, welded in vertical or horizontal positions throughout the flat surface of each wall.

In certain types of electrical apparatuses immersed in fluid, depth, width and length of the internal tank are controlled by the free electrical and mechanical space that is necessary to keep between the internal flat surface of the walls and the external surface of the core and the transformer windings immersed in the tank. Therefore, the internal volume of a cube or parallelepiped tank ends up being very large, so minimal distance required is over-estimated between the internal surfaces of the walls and the external surface of the core and windings mostly, which at the same time increase the quantity of liquid or gaseous fluid required. Being necessary, in some cases, support members are added to prevent deformation of the lateral walls and base because of internal and external pressures.

One way to avoid adding reinforcing elements welded in the tank is to build the lateral walls with one or more trapezoid-shaped undulations, as described by BBC AG. Brown, Boveri & Cie in the Spanish utility model ES-208, 369. The restriction of this proposal is that it does not eliminate the welded supports at all because they can require a channel-type support welded in the large wall sides. At the same time, the free electrical and mechanical space required is still over-estimated between the internal surfaces of the walls and the external surface of the core and windings. In addition, angled corners are formed between the joins of lateral walls, and if the walls have more than one undulation, the tank requires more liquid or gaseous fluid to refill such undulations.

One way to avoid adding reinforcing elements welded to the tank is to build short curve-shaped lateral walls, just as Ito Tatsuo describes in the publication of the British patent application GB-2,050,069. The restriction of this proposal is that it only eliminates the welded supports in the short lateral walls because they are curved, but in the long lateral walls one or more reinforcing welded elements are still required.

Another current tank proposal applied to a transformer is described by Masahiro Kobayashi in the Japanese patent JP-61,135,104. The disclosure describes a tank made up of long lateral walls with one or more curved undulations and the short lateral walls curve-shaped. The restriction of this proposal is that it requires high-precision machinery for its manufacturing, and even so it requires vertical supports welded between the long lateral walls. At the same time, the joint between a long lateral wall and a short lateral wall forms an angled corner.

According to the previous description, which reflects the restrictions of the current tanks for electrical apparatuses immersed in fluids, it is then necessary to offer an easy-to-manufacture tank that eliminates welded support elements, and reduces the isolation and refrigerant fluid volume required, making the tank as small as possible in accordance with the core dimensions and windings, and other connectors and electrical accessories that will be contained within.

BRIEF SUMMARY OF THE INVENTION

According to what has been previously described, and in order to solve the restrictions founded, the purpose of this invention is to provide a tank for an electrical apparatus immersed in fluid formed by a couple of long opposite walls, any of which have one or more supporting folds. A couple of short opposite walls are joined through their lateral ends and define a structure generally parallelepiped-shaped. Such lateral ends join to define a supporting curvature. A base is joined to the lower ends of the parallelepiped. A cover is joined to the upper ends of the parallelepiped covering an internal volume that accommodate at least one core, one or more windings and the electrical apparatus fluid.

Another purpose of the invention is to offer a tank for an electrical apparatus immersed in fluid whose supporting folds define channels that allow them to accommodate within the lateral legs and the lower yoke of the core.

BRIEF DESCRIPTION OF THE SEVERAL VIEWS OF THE DRAWINGS

The proper details of the invention are described in the following paragraphs along with the figures, the purpose of them is to define the invention, but without restricting its scope.

FIG. 1A is a view of the tank without cover, and FIG. 1B is a view of the tank with the cover.

FIG. 1A is a perspective view of the tank, and FIG. 1B is an inverted perspective view of FIG. 1A showing the base in detail.

DETAILED DESCRIPTION OF THE INVENTION

Figure 1A:
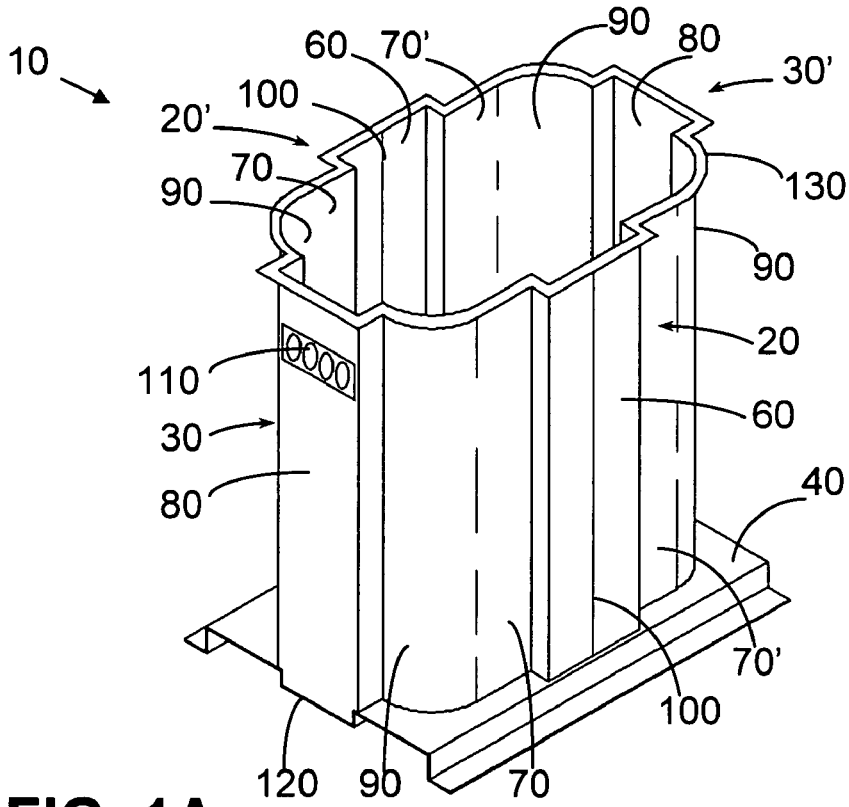
FIGS. 1A and 1B are perspective views of a tank for an electrical apparatus immersed in fluid according to the invention.
Figure 1B:
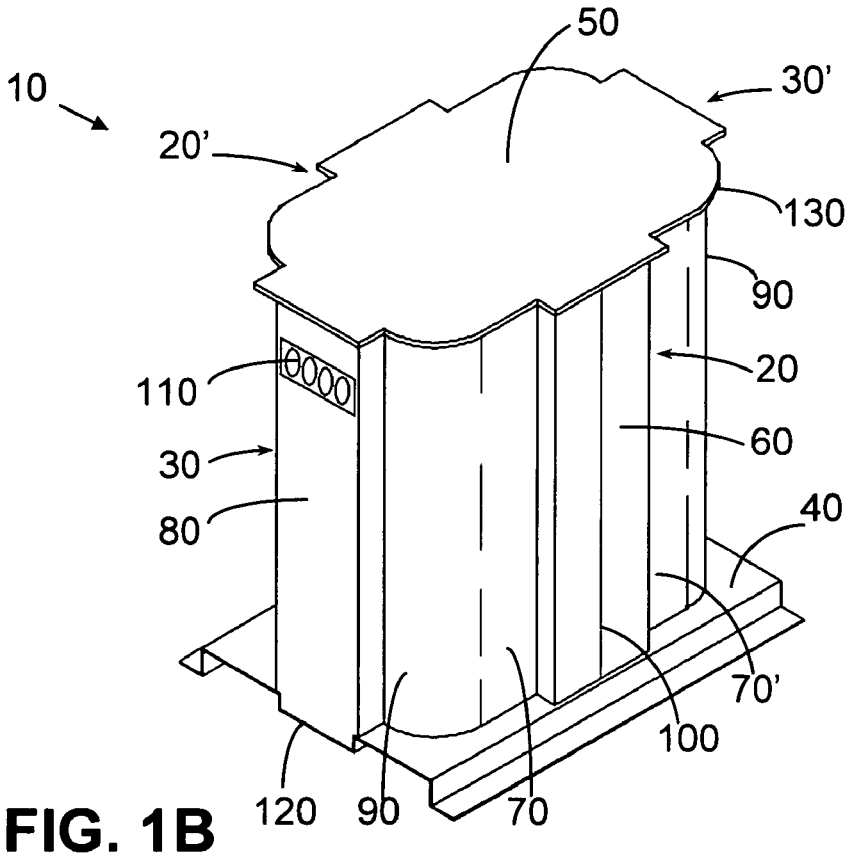

In FIGS. 1A and 1B, perspective views of an embodiment of at tank for an electrical apparatus immersed in fluid are illustrated. A tank 10 to accommodate an electrical apparatus, such as transformers or reactors, is made up of a couple of long opposite walls 20 and 20', a couple of short opposite walls 30 and 30', a base 40, and a cover 50.

The long walls 20 and 20' have one or more supporting folds 60 and a flat portion 70 and 70' on their sides. While short walls 30 and 30' can be made up of a flat surface or one or more supporting folds 80. Each supporting fold 60 and 80 defines a trapezoid, rectangular or curve-shaped channel.

The long walls 20 and 20' and the short walls 30 and 30' are joined to each other through their lateral ends, defining a generally parallelepiped-shaped structure, such a joint defines a supporting curvature 90 in each of the four corners that make up tank 10.

The long walls 20 and 20' and the short walls 30 and 30' have respective sections of a single folded and laminated sheet, so tank 10 is defined by one or more laminated sheets folded and welded to each other, which together define the long walls 20 and 20' and the short walls 30 and 30', and their respective supporting folds 60 and 80, and supporting curvatures 90. FIGS. 1A and 1B illustrate an embodiment of tank 10 that is formed on a basis of two symmetrically folded and laminated sheets and joined by welding lines 100 and 100' located in the center of supporting fold 60 of each long wall 20 and 20'.

The supporting folds 60 and 80, and supporting curvatures 90, together not only increase the mechanical resistance of the structure defined by the long walls 20 and 20' and the short ones 30 and 30'. For some types of electrical apparatuses immersed in fluids, in particular regarding the supporting folds 80 and supporting curvatures 90, the dimensions of the tank 10 are allowed to be reduced. This is further explained in FIG. 2. A characteristic of the supporting curvatures 90 is that allow to reduction of the length from the flat portions 70 and 70' of the long walls 20 and 20', at the same time, the mechanical resistance of these walls and the same tank 10 is increased.

In this embodiment, one or both short walls 30 and 30' have holes and supports 110 for the contacts or electrical accessories (not shown).

The base 40 is joined by means of welding to the lower contour of the structure defined by the joining of long walls 20 and 20' and the short walls 30 and 30'. The base 40 can include one or more supporting folds 120 extended in a longitudinal direction along base 40, in such a way that each one defines a trapezoid, rectangular or curve-shaped channel.

The supporting folds 120 not only have the purpose of increasing the mechanical resistance of base 40 and of the structure defined by the long walls 20 and 20' and the short walls 30 and 30', but for some types of electrical apparatuses immersed in fluids, they also reduce the dimensions of the tank 10. This is further explained in FIG. 3.

Alternatively, a frame 130, with a shape of an upper contour defined by the joining of long walls 20 and 20' and short walls 30 and 30', can be joined by welding to the edges of the upper ends of the walls mentioned. Otherwise, it can be formed on a basis of folds on the upper ends of those walls. This frame 130 acts as an upper reinforcement for tank 10 and as a support for cover 50.

The cover 50 can be rectangular or have a peripheral edge in the form of the upper contour of the structure defined by the joining of long walls 20 and 20' and the short walls 30 and 30', or have the shape of frame 130. The cover 50 is joined by welding to the upper ends of the walls mentioned or over the support defined by frame 130. The cover 50 covers the internal volume that accommodates at least one core, one or more windings, electrical connectors, and the fluid (not shown) that form the electrical apparatus.

The tank 10 can be applied to electrical apparatuses like reactors and transformers. The latter can be, by example, of a station-kind, small-powered, secondary sub-station, padmount transformer or three-phase post among others.

Figure 2:
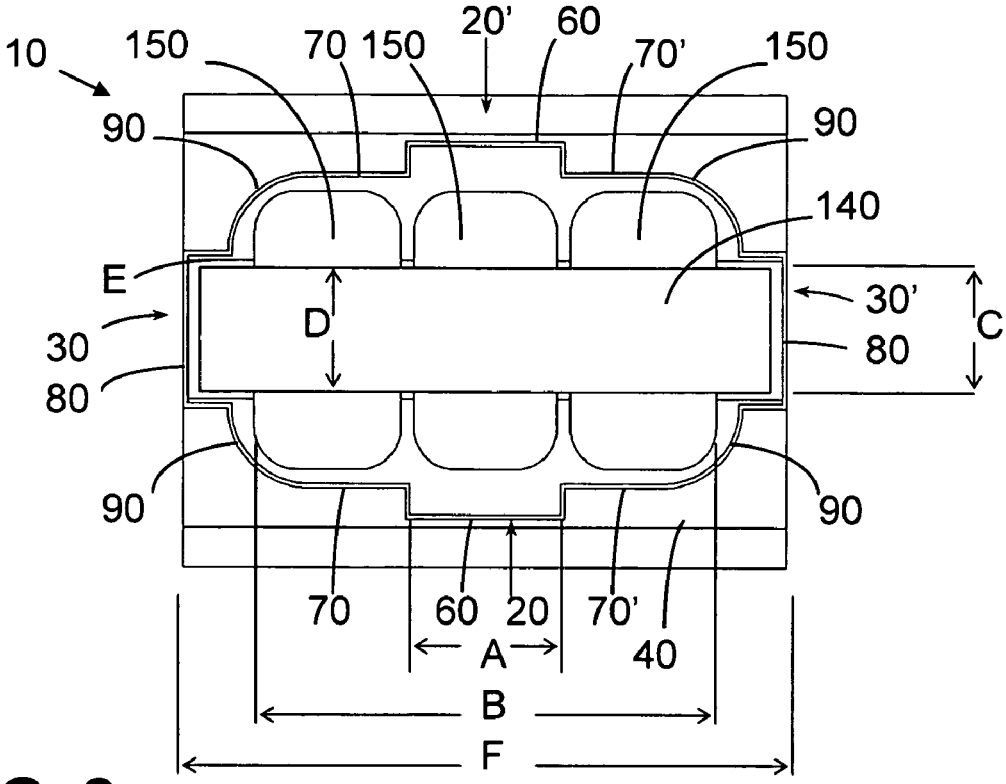
FIG. 2 shows a top cross section view of the tank of FIGS. 1A and 1B.

Now, continuing with FIG. 2, there is a cross view of the upper part of tank 10 showing the contour formed by the joining of the long walls 20 and 20' and the short walls 30 and 30' with their respective supporting folds 60 and 80, flat portions 70 and 70', and supporting curvatures 90. Also, the core 140 and windings 150 in the interior of tank 10 can be observed.

In an electrical apparatus, like a transformer with three windings 150 accommodated in a straight line, width A of the supporting fold 60 of the long walls 20 and 20' is at least one third of the distance B between the external sides of winding 150 which are more separated from each other. Otherwise, a support fold 80 that defines a rectangular channel, width C of the supporting fold 80 of the short walls 30 and 30' is at least 15% larger than width D of core 140. This allows an alternative embodiment to accommodate a lateral leg of core 140 in the interior of each one of supporting folds 80, keeping the separation dielectric distance E and permitting the reduction of the distance along F of tank 10.

The supporting curvatures 90 also allow the mechanical strengthening of the flat portions 70 and 70' of the long walls 20 and 20'. They also allow the reduction of fluid volume required because they stay adjacent to the edge curvature of windings 150 more separated from each other, but keep a separating dielectric distance E.

Figure 3:
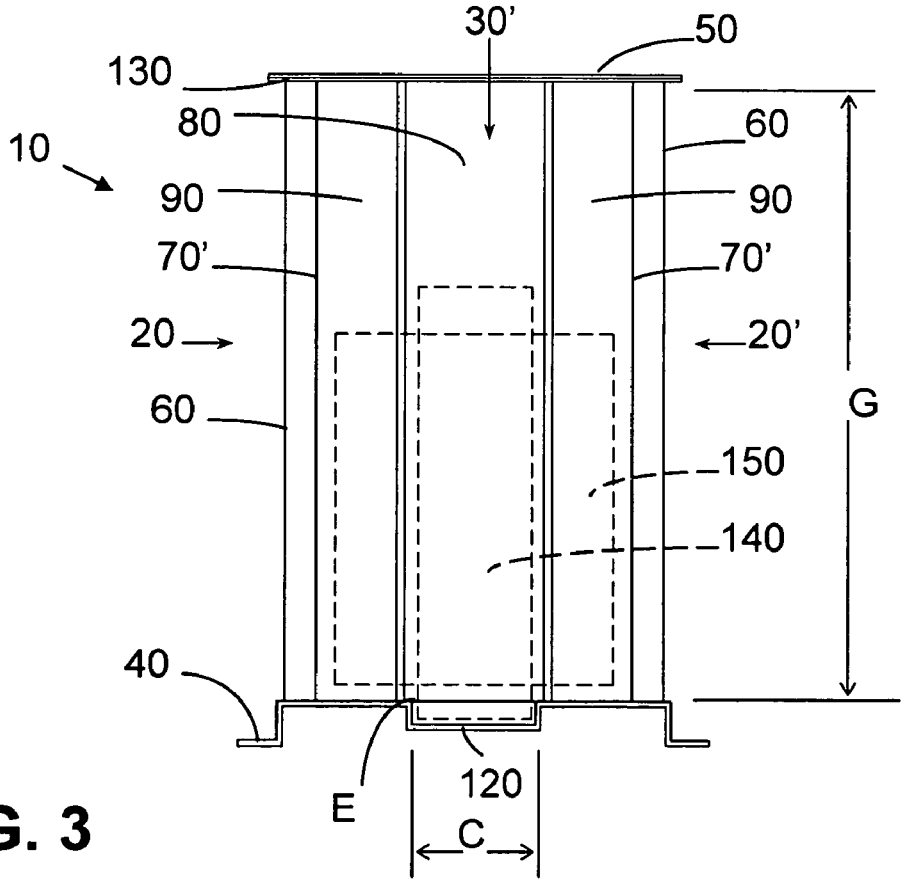
FIG. 3 illustrates an elevation view of the tank of FIGS. 1A and 1B.

FIG. 3 illustrates a side view of tank 10 showing the joining of the long walls 20 and 20' and short wall 30' with their respective supporting folds 60 and 80, flat portions 70 and 70', and supporting curvatures 90. Base 40 and its respective supporting fold 120, core 140 and one winding 150 (both shown in dotted lines) are also observed in the interior of tank 10.

The supporting fold 120, in this case, defining a rectangular channel, has a width C larger at least 15% more than width D of core 140. The width allows the fold 120 to accommodate the lower yoke of core 140 inside supporting fold 120, keeping a dielectric distance E and allowing a reduction of height G of tank 10.

Figure 4A:
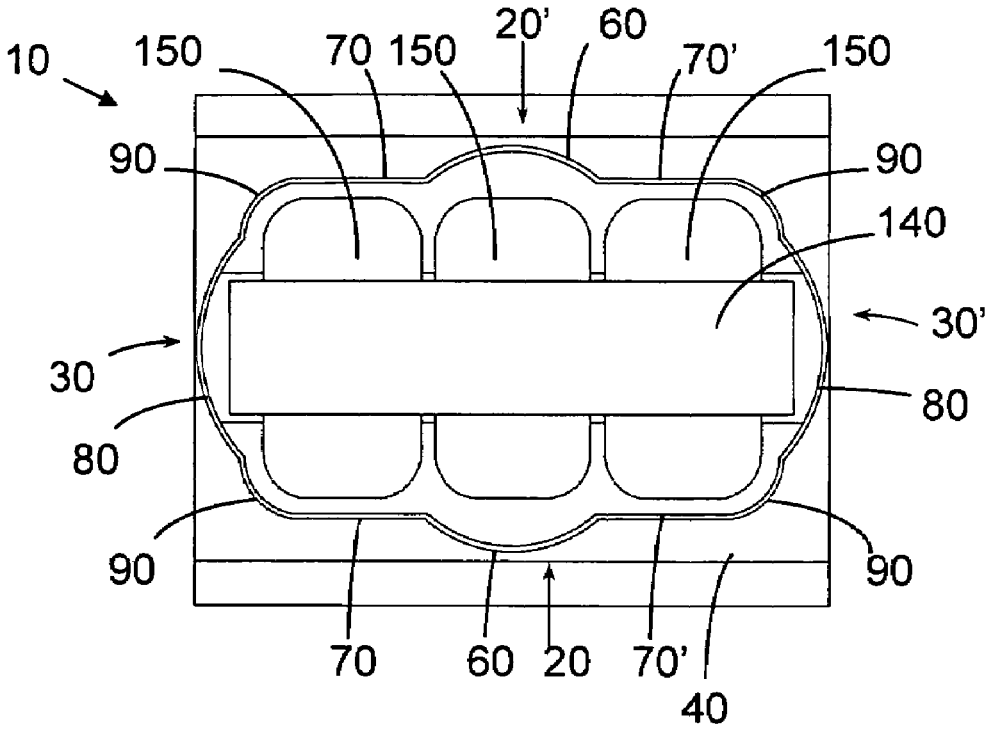
FIGS. 4A and 4B are partial perspective views illustrating alternative embodiments of supporting folding forms of the tank.
Figure 4B:
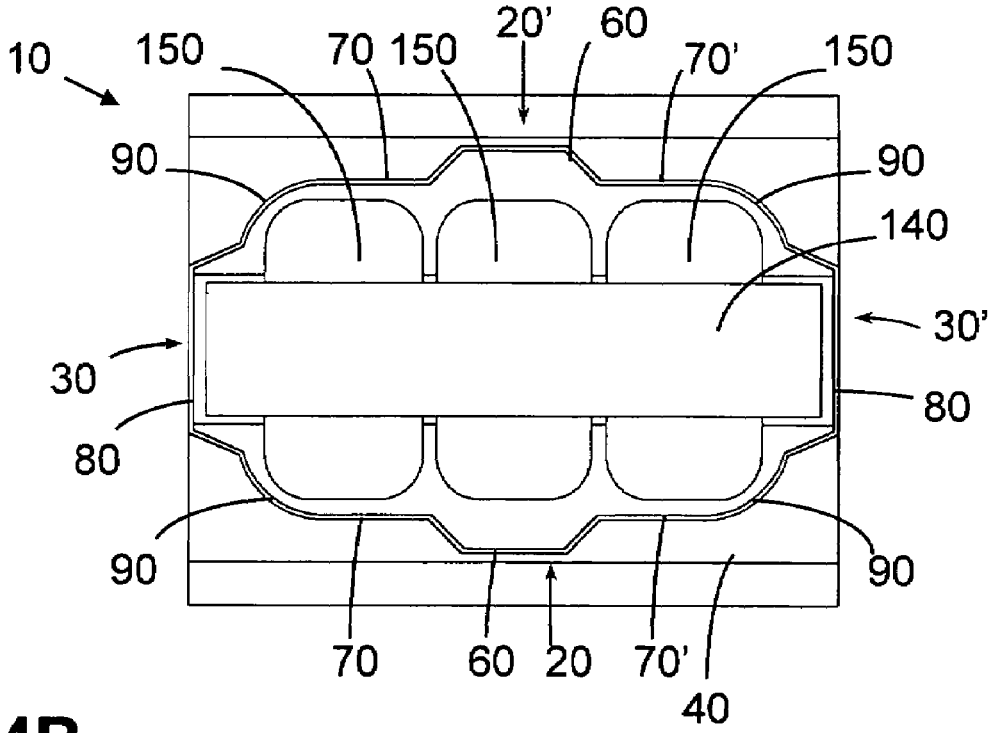

In FIGS. 4A and 4B, a cross view is observed of the upper part of tank 10 showing the contour formed by the joining of the long walls 20 and 20' and the short walls 30 and 30' with their respective supporting folds 60 and 80, flat portions 70 and 70', and supporting curvatures 90. Also, the core 140 and winding 150 inside tank 10 can be observed. In the case of FIG. 4A, how the supporting folds 60 and 80 can have a trapezoid form is observed. Just like FIGS. 4A and 4B, the supporting fold 120 of base 40 can also be curved or trapezoid.

Figure 5A:
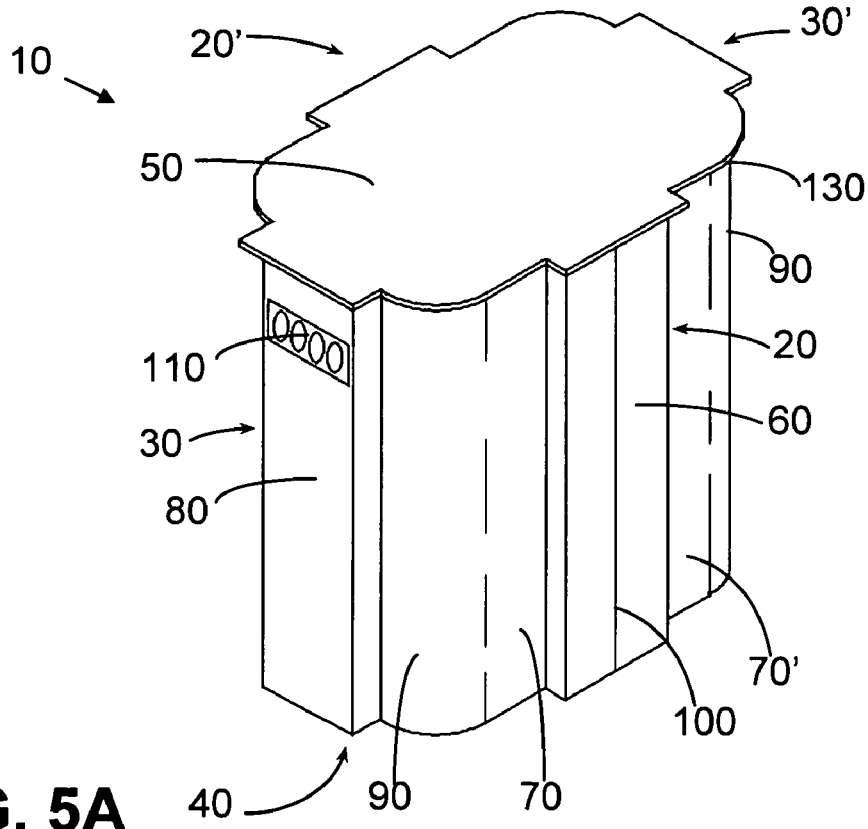
FIGS. 5A and 5B are perspective views of a tank for an electrical apparatus immersed in fluid showing an alternative embodiment of its base.
Figure 5B:
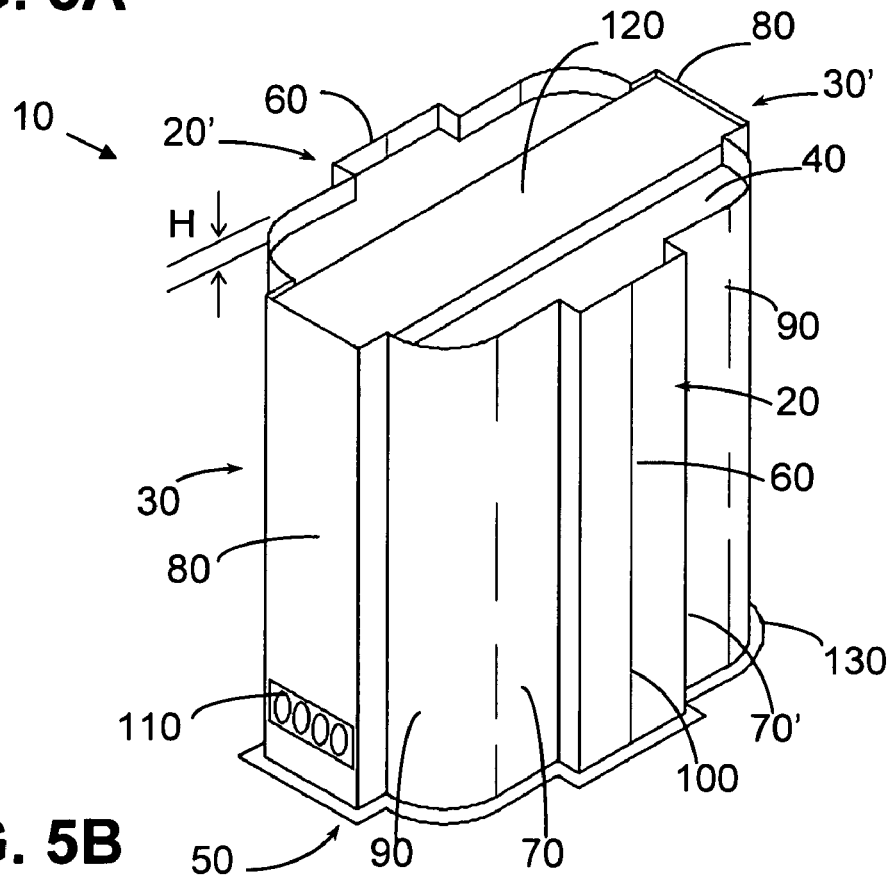

Now, FIGS. 5A and 5B show an alternative embodiment of base 40, which has a peripheral edge in the form of the lower contour of the structure defined by the joining of the long walls 20 and 20' and the short walls 30 and 30'. It is joined by welding to the lower sides of the walls mentioned. According to FIG. 5B, base 40 can be positioned internally in the structure defined by the long walls 20 and 20' and the short walls 30 and 30', therefore it can be positioned at any desired elevation H prior to being joined through welding to the structure. Thus, supporting fold 120 will be at this elevation H.

Figure 6:
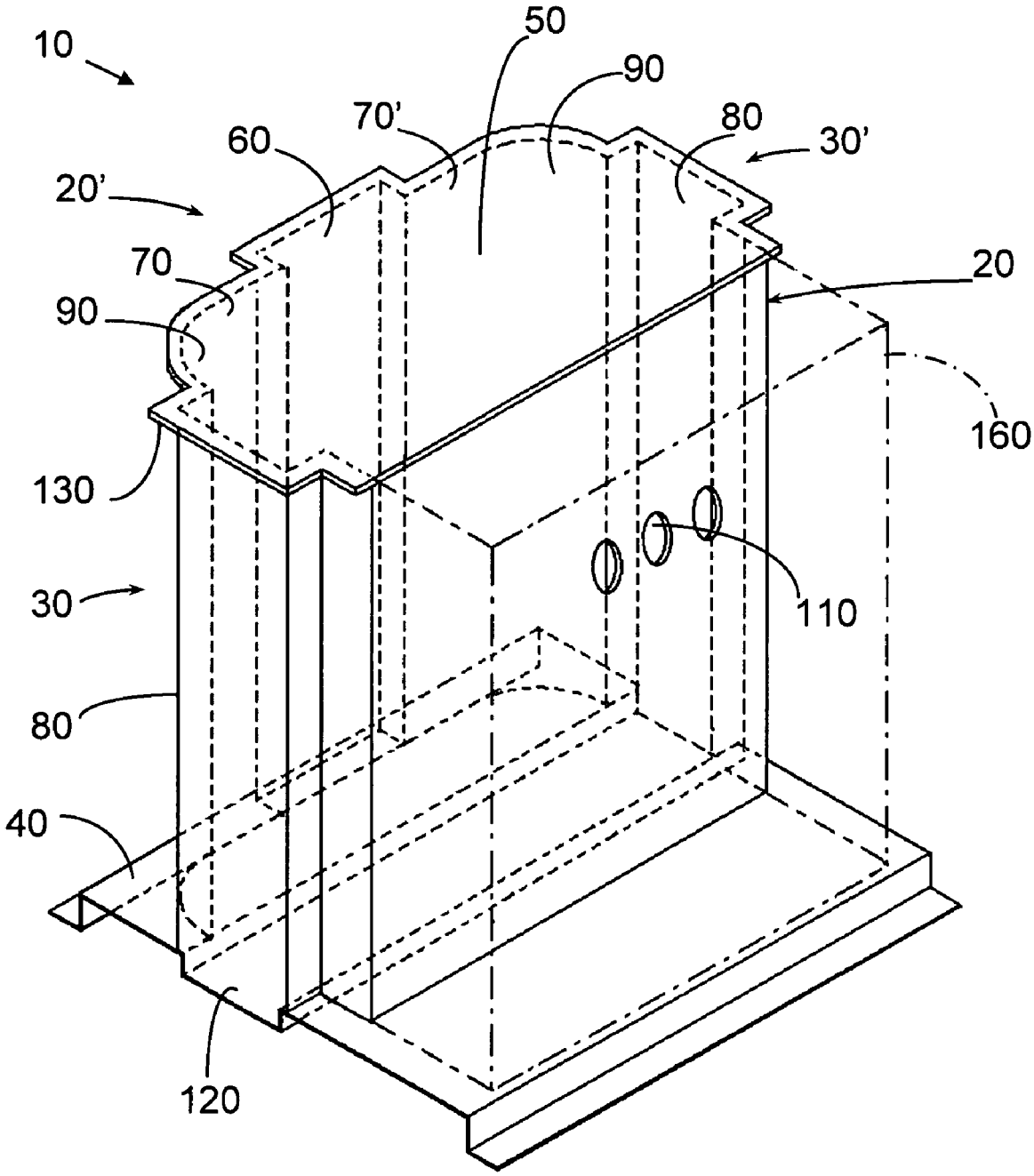
FIG. 6 is a perspective view of a tank for an electrical apparatus, the electrical apparatus being a padmount-transformer type according to the invention.

FIG. 6 shows an alternative embodiment of a tank 10 for padmount transformers. The tank 10 is made up of a couple of long opposite walls 20 and 20', a couple of short opposite walls 30 and 30', a base 40, and a cover 50.

The long wall 20 is a conventional design generally flat-formed and includes a plurality of holes 110 to accommodate and support some electrical connectors and accessories (not shown). A cabinet 60 (shown in dotted lines) is located at the front of the flat frontal wall 20 to cover or hide electrical connectors and accessories (now shown), and typically includes one or more doors allowing access to them.

The long wall 20' has one or more supporting folds 60 and a flat portion 70 and 70' toward their lateral ends, while short walls 30 and 30' can be formed by a flat surface or by one or more supporting folds 80. Each supporting fold 60 and 80 defines a trapezoid, rectangular or curve-shaped channel. The supporting folds 60 and 80 are shown as imaginary portions for visual effect of FIG. 6, but they are part of tank 10.

The long walls 20 and 20' and the short walls 30 and 30' are joined to each other through their lateral ends defining a generally parallelepiped-shaped structure, such joining defines a supporting curvature 90 in the corners corresponding to the join of the long wall 20' and the short walls 30 and 30'. The supporting curvatures 90 are shown as imaginary portions for visual effect of FIG. 6, but they are part of tank 10.

The long walls 20 and 20' and the short walls 30 and 30' have respective sections of a single folded and laminated sheet, so tank 10 is defined by two or more folded sheets and welded to each other, which together define the long walls 20 and 20' and the short walls 30 and 30', as well as their respective supporting folds 60 and 80, and supporting curvatures 90.

The supporting folds 60 and 80 and the supporting curvatures 90, together not only increase the mechanical resistance of the structure defined by the long wall 20' and the short walls 30 and 30', but for some types of padmount transformers, in particular regarding to supporting folds 80 and supporting curvatures 90, these allow the reduction of the dimensions of tank 10, since in the interior of each supporting fold 80 a lateral leg of the core (not shown) is accommodated keeping a separating dielectric distance. The features of supporting curvatures 90 allow the reduction of the length of the flat portions 70 and 70' of the long wall 20', so the mechanical resistance of this wall and of the tank 10 itself increase. They also allow the reduction of the fluid volume required because they stay adjacent to the edge curvature of the winding (not shown), but keep a separating dielectric distance.

The base 40 is joined by welding to the lower contour of the structure defined by joining of the long walls 20 and 20' and short walls 30 and 30'. The base 40 can include one or more supporting folds 120 extended in a longitudinal direction along base 40, so each one defines a trapezoid, rectangular or curve-shaped channel. The supporting fold 120 is shown as an imaginary portion for visual effect of FIG. 6, but they are part of tank 10.

The supporting fold 120 not only has the purpose of increasing the mechanical resistance of base 40 and of the structure defined by the long walls 20 and 20' and the short walls 30 and 30', but for some types of padmount transformers they allow to accommodate the lower yoke of the core (not shown) inside supporting fold 120, keeping a dielectric distance and allowing the reduction of height of tank 10.

Alternatively, a frame 130, with a shape of an upper contour defined by the joining of the long walls 20 and 20' and short walls 30 and 30', can be joined by welding to the edges of the upper ends of the walls mentioned, or it can be made up of folds done on the upper ends of those walls. This frame 130 acts as an upper reinforcement for tank 10 and as a support of cover 50.

The cover 50 can be rectangular or have a peripheral edge of the upper contour of the structure defined by the joining of long walls 20 and 20' and short walls 30 and 30' walls, or have the shape of frame 130. The cover is joined by welding to the upper ends of the walls mentioned or over the support defined by frame 130. The cover 50 covers the internal volume that accommodates at least one core, one or more windings, electrical connectors, and the fluid (not shown) forming the padmount transformer.

Based on the embodiment alternatives described previously, it is considered that the modifications to the embodiment of the invention, as well as the alternative embodiments will be considered evident for an expert in the technical art under the present description. It is therefore considered that the claims include such modifications and alternative embodiments inside the scope of the invention or its equivalents.

I claim:

1. A tank for an electrical apparatus immersed in fluid, said tank comprising:

a plurality of opposing walls, wherein one or both opposing walls have one or more supporting folds;

a plurality of alternate opposing walls joined to said opposing walls through lateral ends thereof, defining a generally parallelepiped-shaped structure, wherein joining of said lateral ends defines a supporting curvature;

a base joined to lower ends of said generally parallelepiped-shaped structure, defined by joining said opposing and alternate opposing walls; and a cover joined to upper ends of the parallelepiped-shaped structure, covering an internal volume that accommodates one core, one or more windings and fluid of said electrical apparatus.

2. The tank of claim 1, wherein each supporting fold of each opposing wall defines a trapezoid, rectangular or curve-shaped channel.

3. The tank of claim 1, wherein said supporting fold of said opposing wall has a width being one third closer to a distance between external ends of a winding more separated from each other.

4. The tank of claim 1, wherein one or two of said alternate opposing walls has one or more supporting folds.

5. The tank of claim 4, wherein each supporting fold of each alternate opposing wall defines a trapezoid, rectangular or curve-shaped channel.

6. The tank of claim 5, wherein the channel of one or two of said alternate opposing walls is comprised of a surface with a plurality of holes, being engageable and supporting electrical connectors and accessories of said electrical apparatus.

7. The tank of claim 5, wherein the channel of said alternate opposing wall accommodates each lateral leg of said core therealong the channel.

8. The tank of claim 7, wherein the channel of said alternate opposing wall has a width at least 15% larger than a width of said core.

9. The tank of claim 1, wherein said base further comprises one or more supporting folds.

10. The tank of claim 9, wherein each supporting fold of said base defines a trapezoid, rectangular or curve-shaped channel.

11. The tank of claim 10, wherein the channel of said base accommodates a lower yoke of said core therealong the channel.

12. The tank of claim 11, wherein the channel defined by said supporting fold at said base has a width at least 15% larger than a width of said core.

13. The tank of claim 1, wherein said opposing and alternate opposing walls are comprised of respective sections of a single laminated and folded sheet.

14. The tank of claim 13, wherein two or more of the single laminated and folded sheets, forming sections on said opposing and alternate opposing walls, are welded to ends thereof, forming generally a parallelepiped.

15. The tank of claim 1, wherein one opposing wall further comprises supports for electrical connectors and accessories.

16. The tank of claim 15, wherein said electrical connectors and accessories in said one opposing wall are covered by a cabinet.

17. The tank of claim 1, wherein said base is positioned at a higher elevation than lower ends of the parallelepiped-shaped structure.

18. The tank of claim 1, wherein each support curvature is close to an edge of a winding and separate at a dielectric distance.

* * * * *